US006648178B2

(12) United States Patent
Grunewald

(10) Patent No.: US 6,648,178 B2
(45) Date of Patent: Nov. 18, 2003

(54) TAP LOCK APPARATUS AND METHODS OF OPERATION THEREOF

(76) Inventor: Jeffrey Grunewald, 729 211th St., Dyer, IN (US) 46311-1107

( * ) Notice: Subject to any disclaimer, the term of this patent is extended or adjusted under 35 U.S.C. 154(b) by 0 days.

(21) Appl. No.: 09/997,256

(22) Filed: Nov. 28, 2001

(65) Prior Publication Data

US 2003/0102331 A1 Jun. 5, 2003

(51) Int. Cl.[7] ..... B67D 5/32

(52) U.S. Cl. ..... 222/153.02; 222/153.03; 222/153.13; 222/400.7

(58) Field of Search ..... 222/153.02, 153.03, 222/153.11, 153.15, 400.7, 400.8

(56) References Cited

U.S. PATENT DOCUMENTS

| | | | | | |
|---|---|---|---|---|---|
| 784,994 | A | | 3/1905 | Durafort | |
| 999,983 | A | | 8/1911 | Gardner | |
| 1,380,675 | A | | 6/1921 | Myers | |
| 4,111,243 | A | | 9/1978 | Fetterman | 141/102 |
| 4,291,821 | A | * | 9/1981 | Nezworski | 137/212 |
| 4,911,333 | A | * | 3/1990 | Wilson | 222/153.14 |
| 5,287,874 | A | | 2/1994 | Dixon et al. | 137/1 |
| 5,394,715 | A | | 3/1995 | Guérette | 70/177 |
| 5,487,493 | A | * | 1/1996 | McNabb | 222/146.6 |
| 5,607,084 | A | | 3/1997 | George | 222/153.03 |
| 5,918,766 | A | * | 7/1999 | Osborne | 222/153.03 |
| 5,941,103 | A | | 8/1999 | Stearns | 70/178 |
| 6,082,598 | A | * | 7/2000 | Lee | 222/153.14 |

* cited by examiner

*Primary Examiner*—Joseph A. Kaufman
(74) *Attorney, Agent, or Firm*—Baniak Pine & Gannon

(57) ABSTRACT

An apparatus and method are provided for deterring or hindering any operation or dispensing of fluid through one or more taps by an unauthorized user. The apparatus is a tap block, the tap block including a block wall having a block exterior surface and a block interior surface, the block interior surface defining a nozzle receiving cavity sized and shaped relative to the nozzle exterior surface such that at least a portion of the nozzle adjacent to the nozzle outlet may be received therein, the block wall including a nozzle receiving aperture opening from the block exterior surface through the block wall to the nozzle receiving cavity, the nozzle receiving aperture opening sized and shaped relative to the nozzle exterior surface such that at least the nozzle portion insertable into the nozzle receiving cavity may be received therethrough; and a securing device, the securing device is capable of maintaining said position of the tap block relative to the tap nozzle.

12 Claims, 3 Drawing Sheets

TAP LOCK APPARATUS AND METHODS OF OPERATION THEREOF

This invention relates generally to fluid dispensers and more particularly to an apparatus and methods for deterring any use of one or more taps or faucets.

BACKGROUND OF THE INVENTION

The present invention has its genesis in the beer and tavern industry. While the invention will be particularly discussed with respect to embodiments in the beer and tavern industry arena, one should understood that this industry is but one application of the invention, and the invention has much broader scope.

Fluids are dispensed from reservoirs through a variety of apparatus and systems. For example, soda water and flavoring syrups can be dispensed from reservoirs through a "soda gun." Gasoline can be dispensed through a gasoline hose and a gasoline nozzle. Outdoor water at one's home is typically dispensed from a water hose faucet. Beer can be dispensed from a keg through a tap with a nozzle. These and other dispensing devices, such as spigots, valves, and cocks, are well known devices for dispensing fluid from a reservoir by controlling a flow path of the fluid. These devices are referred to as "taps" hereinafter.

While some taps are more detailed, in its simplest form a tap includes a hollow shank with a handle aperture, a nozzle aperture, a nozzle with a nozzle exterior surface and a nozzle interior surface the defining an internal flow path through which a fluid may flow to a nozzle outlet. The tap also includes a valve, and a pivotal tap handle with an exterior surface. The internal flow path is hydraulically connected to a keg or fluid reservoir. A valve seat is formed circumferentially within the flow path. The valve with a valve stem is configured and positioned within the internal flow path such that the valve can be seated within the valve seat. When the valve is seated, the tap is closed thereby preventing any flow of fluid through the internal flow path. The pivotal tap handle has an exterior portion and an interior portion and is configured and positioned to extend through the handle aperture in the hollow shank such that the interior portion of the pivotal tap handle is in mechanical communication with the valve stem. The exterior portion of the pivotal tap handle can include a removable custom-made tap handle The pivotal tap handle, the valve, and the shank are constructed and configured such that any movement of the pivotal tap handle will control any movement of the valve relative to the valve seat. The tap is configured and constructed such that when the pivotal tap handle is moved toward an open position, the interior portion of the pivotal tap handle moves within the flow path, thus further moving the valve away from the valve seat. The movement of the valve results in the valve being "unseated" from the valve seat. Once the valve is unseated, fluid is dispensed from the reservoir or hydraulic supply through the internal flow path of the hollow shank, between the valve seat and the valve, through the internal flow path along the valve stem, though the nozzle aperture, through the nozzle, and out the nozzle outlet.

Packing is located within the hollow shank about the interior portion of the pivotal tap handle and the handle aperture whereby fluid is prevented from prevented from escaping from the interior flow path of the hollow shank through the handle aperture about the interior portion of the pivotal tap handle. A packing nut is attached to the exterior of the hollow shank about the handle aperture to retain the packing and the interior portion of pivotal tap handle located within the internal flow path.

Examples of taps include a keg tap, soda fountain dispensers, and tap towers. These and related apparatus are used to dispense beer in bars, water from a faucet at one's home, or gasoline from a tank. Taps are convenient because a user can quickly and easily provide flow of fluid from the tap with a minimal amount of effort. On the other hand, the convenience of the tap has a drawback in that unauthorized users can also quickly draw fluid from an unattended tap.

Most bars and taverns utilize standardized tap systems. In its simplest form, a commercial tap system includes a pressurized C02 tank, a tank line, a regulator, a regulator line, a keg, a keg line, and a "tap tower." The tap tower includes a tap, as previously described, for dispensing beer. The tap system is configured such that pressurized C02 tank, the tank line, and the regulator are used to pressurize the keg. Thus, the pressurized keg results in beer flowing from the keg, through the keg line, to the tap, and out of the nozzle outlet if the valve is unseated from the valve seat. The pressurized system keeps the keg "pressurized" thus maintaining the freshness of the beer.

A commercial tap system may have a tap tower that contains numerous taps for dispensing several different types of beer from numerous kegs. For example, a commercial tap system may have four taps to dispense four different beers from four different kegs. Each type of beer is dispensed from the respective kegs through one of four different keg lines to the tap tower and out the corresponding tap nozzle. Commercial tap systems allow a person to easily and quickly operate one or more of the taps of the tap tower at any time. As such, a need exists to prevent theft of beer from tap towers by unauthorized persons.

Additionally, industry standard custom-made tap handles are used that can be retrofit to a commercial tap system. The custom-made tap handles typically screw onto a threaded stud or stem that is part of the exterior portion of the tap handle. The custom-made tap handles come in various shapes and sizes and are used to identify the specific type of beer that can be dispensed from each tap of the tap tower. One example of the custom-made tap handles is the tap handle for Goose Island Brewing Co., which is in the shape of a neck and a head of a white goose[1]. Other custom-made tap handles are like a classic tap handle shape and include a logo emblem, such as George Killian's Irish Red Brand beer tap handle[2]. Still, other custom-made tap handles resemble a tab shape or a flattened rectangular box shape that includes a logo, such as a Coors Light beer tap handle[3].

One problem with the custom made tap handles is that some people consider possessing tap handles a novelty, or a person may simply want the unique handles for use at their home bar. As such, custom-made tap handles are often taken from un-attended tap towers because of the ease in which the handles can be removed. As such, a need exists to prevent theft of custom-made tap handles from tap towers.

An additional problem with the custom-made tap handles is one of the purposes for providing such handles to bars and taverns is to advertise that the supplier's beer is for sale. As such, it becomes important to beer suppliers not only to have the beer for sale, but to also have one's beer dispensed from a noticeable tap, such as a tap on an end of the tap tower. Currently, tavern owners can choose to configure their tap systems to dispense beer from any tap on a tap tower as each desires. A need exists for the encouragement of bar and tavern owners to maintain the dispensing of a beer supplier's product from the most noticeable tap of a tap tower.

Many devices have been developed in an attempt to solve these problems. Some of the devices are designed to allow a user to secure a tap so that an unauthorized user cannot operate the tap. These devices can be grouped into three different categories. The first category includes devices that secure the handle of a tap is some manner. Such a device is disclosed in U.S. Pat.No. 784,994 by Durafort. The Durafort patent discloses an apparatus for dispensing

[1] Goose Island is a register trademark of Goose Island Brewing co. of Chicago, Ill.

[2] George Killian's Irish Red Brand is a registered trademark of Brasseries Pelforth Corp of France.

[3] Coors Light is a registered trademark of Coors Brewing company of Golden, Col. beer or other liquids that includes a stirrup and padlock to lock the handle in place when not in use.

Several disadvantages exist in using a locking device of this type. One disadvantage is that one locking device is needed for each tap handle. For instance, three taps handles would require three locking devices. Additionally, because tap handles vary considerably in size and shape, a variety of different sizes and shapes would be needed. Also, an establishment having many different sized and shaped taps handles locked with corresponding handle locks would need to keep the keys for such locks relatively accessible, thereby possibly defeating the purpose of the locks. Finally, many of these devices would be ineffective on modern taps in that the tap handle can be unscrewed and removed from the stem of the handle thus rendering the stirrup and padlock ineffective.

The second category of securing devices includes devices that encase at least that portion of the tap containing the tap handle. Such a device is disclosed in U.S. Pat.No. 1,380,675 by Meyers. The Meyers patent discloses a gas cock and faucet protector. The Meyers patent utilizes a protector that fits entirely around the handle of a tap. Any use of the tap is not possible when the protector is locked in place. Again, a different sized and shaped protector is needed for each different sized and shaped tap and thereby also be a costly solution to the tap locking problem. Employing a plurality of such protectors on a daily basis would be expensive and time consuming. Additionally, the protectors would be difficult to store when not in use.

The third category of securing devices employs a special type of handle on the tap. One of these devices is disclosed in U.S. Pat.No. 5,287,874 by Dixon et al The Dixon patent discloses an "anti-use" cap for an exterior water faucet. This device has a cap that permanently replaces a conventional packing nut and handle. The outer portion of the cap has a locking mechanism that is operated by a special key or tool. The tap is opened or closed by inserting the special key into a pair of axially extended parallel radially spaced openings in the cap and turning the special key to move the stem and open the seal plug. This type of securing device is permanently attached to the tap and the special key is needed every time the tap is operated. This type of lock again requires one lock for each tap. Even if the same key could be used for multiple locks, employing a plurality of these locks on a daily basis would be time consuming since an operator can only open one tap at a time. With different potential operators, the same key would need to be readily accessible or multiple keys made, thereby possibly defeating the purpose of the device.

While these devices are useful in many applications, each of the above types of securing devices is designed for use with a single tap. Accordingly, there is a need to deter or hinder operation of a tap by unauthorized users that can be used on a single tap or on a plurality of taps, that is not cumbersome to move or store when not in use, and that can be installed and uninstalled in a quick manner as well as a device to prevent theft of custom-made tap handles, and to encourage bar and tavern owners to maintain the dispensing of a beer supplier's product from the most noticeable tap of a tap tower. The present invention satisfies these demands.

SUMMARY OF THE INVENTION

When I set out to make the present invention, and then in the course of developing the invention, I had a number of objectives in mind, which the present invention accomplishes.

Broadly speaking, the principal objective of this invention is provide a tap locking apparatus to deter unauthorized persons from dispensing any fluid from one or more taps. In its simplest form, the tap lock includes a tap block and a securing device. The tap block includes a block wall. The block wall has a block exterior surface and a block interior surface. The block interior surface defines a nozzle receiving cavity that is sized and shaped relative to the exterior surface of the nozzle of the tap to be locked. The nozzle receiving cavity can receive at least a portion of the nozzle adjacent to the nozzle outlet.

The block wall also including a nozzle receiving aperture opening from the exterior surface of the block through said block wall to said nozzle receiving cavity. This allows one to access the nozzle receiving cavity. The nozzle receiving aperture opening is also sized and shaped relative to the exterior surface of the nozzle of the tap to be locked. With the tap block defined as having the nozzle receiving aperture opening and the nozzle receiving cavity, one can position at least a portion of the nozzle of the tap to be locked through the nozzle receiving aperture opening and into the nozzle receiving cavity. Once the nozzle is positioned within the nozzle receiving cavity, the securing device can be used to maintain the position of the tap block relative to the tap nozzle.

It is another objective of the present invention to provide a tap lock for use on a tap with a drain pipe or conduit. Such a device would deter operation of the tap, but avoid any spillage of any fluid dispensed. In the simplest form of this invention includes a tap block and a securing device. The tap block includes a block wall with a block exterior surface and a block interior surface. The block interior surface defines a nozzle receiving cavity that is sized and shaped relative to the exterior surface of the nozzle of the tap to be locked such that at least a portion of the nozzle adjacent to the nozzle outlet may be received within the nozzle receiving cavity.

The block wall also includes a nozzle receiving aperture opening. The nozzle receiving aperture opening extends from exterior surface of the block to the nozzle receiving cavity. The nozzle receiving aperture opening is also sized and shaped relative to the nozzle exterior surface. With the tap block defined as having the nozzle receiving aperture opening and the nozzle receiving cavity, one can position at least a portion of the nozzle of the tap to be locked through the nozzle receiving aperture opening and into the nozzle receiving cavity.

The block wall also includes a hydraulic outlet that is in fluid communication with said nozzle receiving cavity. A drain conduit with a first end and a second end is connected in fluid communication at the first end of the drain conduit to the hydraulic outlet. The second end of the drain conduit is configured as to be inaccessible to a user and is in connected in fluid communication with a drain. The tap block is secured in place about the nozzle of the tap by use of the securing device. Thus, if a person opens the tap with the tap lock in place, any fluid dispensed from the tap outlet flows into the hydraulic outlet, into and through the drain conduit and into the drain.

It is yet another objective of this invention is provide a tap locking apparatus that employs a plug type lock as opposed to the cavity type lock referred to above. In the simplest form of this invention also includes a tap block and a securing device. The tap block includes a block wall with a block exterior surface. The block exterior surface defines a protrusion that is sized and shaped relative to the tap outlet and interior surface of the nozzle of the tap to be locked such that at least a portion of the protrusion may be received within the nozzle outlet. The tap block is secured in place relative to the nozzle of the tap by use of the securing device. Thus, if a person opens the tap with the tap lock in place, any fluid dispensed from the tap outlet must flow between the protrusion and the interior surface of the nozzle. Any fluid flowing in the area between the protrusion and the interior surface of the nozzle is thus accelerated as in a venturi tube. As such, if the fluid dispensed were beer or the like, the accelerated flow would result in "foamy" beer, thus deterring any use of the tap, since no one prefers "foamy" beer.

It is another objective of this invention is provide a tap locking apparatus to deter unauthorized persons from dispensing any fluid from one or more taps as well as prevent theft of custom-made tap handles. In its simplest form, the tap lock includes a tap block, a handle block, and a securing device. The tap block includes a block wall. The block wall has a block exterior surface and a block interior surface. The block interior surface defines a nozzle receiving cavity that is sized and shaped relative to the exterior surface of the nozzle of the tap to be locked. The nozzle receiving cavity can receive at least a portion of the nozzle adjacent to the nozzle outlet.

The block wall also including a nozzle receiving aperture opening from the exterior surface of the block through said block wall to said nozzle receiving cavity. This allows one to access the nozzle receiving cavity from the nozzle receiving aperture opening. The nozzle receiving aperture opening is also sized and shaped relative to the exterior surface of the nozzle of the tap to be locked. With the tap block defined as having the nozzle receiving aperture opening and the nozzle receiving cavity, one can position at least a portion of the nozzle of the tap to be locked through the nozzle receiving aperture opening and into the nozzle receiving cavity.

The tap lock also includes the handle block with a handle block wall. The handle block wall has a handle block exterior surface and a handle block interior surface. The block interior surface defines a handle receiving aperture opening that is sized and shaped relative to the exterior surface of the handle of the tap to be locked. The handle receiving aperture opening can receive at least a portion of the handle.

Once the nozzle is positioned within the nozzle receiving cavity and the handle is positioned within the handle receiving cavity of the handle block, the securing device can be used to maintain the position of the tap block relative to the tap nozzle as well as to maintain the position of the handle block relative to the tap handle. ID It is another objective of the present invention to provide a the tap lock for use on a tap tower with multiple taps in a tavern or bar to deter or inhibit any dispensing of beer such as when the bar is unattended or during times when it is illegal to serve alcohol. The invention includes a tap block and one or more securing devices. The tap block includes a block wall with a block exterior surface and a block interior surface. The block interior surface defines one or more nozzle receiving cavities that correspond to the one or more nozzles of the taps to be locked. The one or more nozzle receiving cavities are sized and shaped relative to the one or more corresponding nozzle exterior surface such that at least a portion of the each of the corresponding nozzles adjacent to the corresponding nozzle outlets correspond to each of the one or more nozzle receiving cavities. The block wall including one or more nozzle receiving aperture openings from said block exterior surface through said block wall to said. corresponding nozzle receiving cavities. As such one can simultaneously insert a portion of each tap nozzle through the respective nozzle receiving aperture opening and into the respective nozzle receiving cavity. The one or more securing devices are capable of maintaining the position of the tap block relative to the one or more tap nozzles.

It is another objective of the present invention to provide a method of operation of the immediately preceding objective of employing tap lock on a tap tower with multiple taps in a tavern or bar to deter or inhibit any dispensing of beer such as when the bar is unattended or during times when it is illegal to serve alcohol. The method includes the steps of positioning the tap block such that a portion of each of the one or more tap nozzles is received within the corresponding one or more nozzle receiving cavities and securing said tap block relative to the one or more tap nozzles by use of said one or more securing devices.

It is another objective of the present invention to provide a the tap lock for use on a tap tower with multiple taps in a tavern or bar to deter or inhibit any dispensing of beer such as when the bar is unattended or during times when it is illegal to serve alcohol. The invention includes a tap block and one or more securing devices. The tap block includes a block wall having a block exterior surface and a block interior surface. The block interior surface defines one or more nozzle receiving cavities that are sized and shaped relative to the one or more corresponding nozzle exterior surfaces such that at least a portion of the corresponding nozzle adjacent to the corresponding nozzle outlet may be received therein. The block wall also includes one or more nozzle receiving aperture openings from the exterior surface of the tap block through said block wall to the corresponding nozzle receiving cavities. The one or more nozzle receiving aperture openings are sized and shaped relative to the corresponding nozzle exterior surface such that a portion of the corresponding nozzle portion is insertable into the one or more nozzle receiving cavities. The block wall also includes one or more hydraulic outlets that are in fluid communication with the one or more corresponding nozzle receiving cavities.

A drain conduit having a first end and a second end is also included. The first end of the drain conduit is connected to and in fluid communication with the one or more hydraulic outlets. The second end of said drain conduit is configured as to be inaccessible to a user and is in fluid communication with a drain. The drain, the drain conduit, the one or more hydraulic outlets, and the one or more nozzle receiving cavities are configured as to all be in fluid communication with each other. The one or more securing devices are capable of maintaining said position of said tap block relative to the one or more tap nozzles. Thus if any or all of the taps are opened to dispense fluid, the fluid flows into the respective one or more nozzle receiving cavity, into the respective hydraulic outlet, into the drain conduit, and into the drain.

It is another objective of the present invention to provide a method of operation of the immediately preceding objective of employing tap lock on a tap tower with multiple taps in a tavern or bar to deter or inhibit any dispensing of beer such as when the bar is unattended or during times when it is illegal to serve alcohol. The method includes the steps of positioning the tap block such that a portion of each of the one or more tap nozzles is received within the corresponding one or more nozzle receiving cavities and securing said tap block relative to the one or more tap nozzles by use of said one or more securing devices.

It is another objective of the present invention to provide a the tap lock for use on a tap tower with multiple taps in a tavern or bar to deter or inhibit any it dispensing of beer such as when the bar is unattended or during times when it is illegal to serve alcohol. The invention includes a tap block and one or more securing devices. The tap block includes a block wall having a block exterior surface. The block exterior surface defines one or more protrusions; each of which correspond to one of the one or more taps. Each of the one or more protrusions are sized and shaped relative to the corresponding nozzle outlets and to the corresponding one or more nozzle interior surfaces such that at least a portion of the one or more protrusions are insertable into the corresponding nozzle outlet. The one or more securing devices are capable of maintaining the position of the tap block relative to the one or more tap nozzles.

It is another objective of the present invention to provide a method of operation of the immediately preceding objective of employing tap lock with one or more protrusions on a tap tower with multiple taps in a tavern or bar to deter or inhibit any dispensing of beer such as when the bar is unattended or during times when it is illegal to serve alcohol. The method comprising the steps of positioning the tap block such that each of the one or more protrusions of the tap block is received within each of the one or more tap nozzles of the tap tower and securing said tap block relative to the one or more tap nozzles by use of said one or more securing devices.

It is another objective of the present invention to provide a the tap lock for use on a tap tower with multiple taps in a tavern or bar to deter or inhibit any dispensing of beer such as when the bar is unattended or during times when it is illegal to serve alcohol and to prevent the removal of any of the custom-made tap handles. The invention includes a tap block, a handle block, and one or more securing devices. The tap block includes a block wall having a block exterior surface and a block interior surface. The block interior surface defines one or more nozzle receiving cavities. Each of said one or more nozzle receiving cavities correspond to one of the one or more taps of the tap tower. Each of said one or more nozzle receiving cavities are sized and shaped relative to the corresponding nozzle exterior surface such that at least a portion of the corresponding nozzle adjacent to the corresponding nozzle outlet can be received therein. The block wall also includes a one or more nozzle receiving aperture openings from the exterior surface of the block wall through said block wall to the corresponding one or more nozzle receiving cavities. The nozzle receiving aperture openings are sized and shaped relative to the corresponding nozzle exterior surface such that at least the corresponding nozzle portion is insertable into said corresponding nozzle receiving cavity and can be received therein.

The handle block includes a handle block wall having a handle block exterior surface and a handle block interior surface. The handle block interior surface defines one or more handle receiving cavities. Each of the one or more handle receiving cavities correspond to one of the one or more handles of the one or more taps. Each of the one or more handle receiving cavities are sized and shaped relative to the corresponding handle exterior surface such that at least a portion of the corresponding handle may be received therein. The handle block wall includes one or more handle receiving aperture openings from said handle block exterior surface through the handle block wall to the corresponding handle receiving cavities. The handle receiving aperture openings are sized and shaped relative to each of the corresponding handle exterior surface such that at least the corresponding handle portion is insertable into said corresponding handle receiving cavity and may be received therein.

The one or more securing devices are capable of maintaining the position of the tap block relative to the one or more tap nozzles and the position of the handle block relative to the one or more tap handles.

It is another objective of the present invention to provide a method of operation of the immediately preceding objective of employing tap lock on a tap tower with multiple taps in a tavern or bar to deter or inhibit any dispensing of beer such as when the bar is unattended or during times when it is illegal to serve alcohol as well as to prevent removal of any of the one or more tap handles. The method comprising the steps of: positioning the tap block such that a portion of each of the one or more tap nozzles is received within said corresponding one or more nozzle receiving cavities; positioning the handle block such that a portion of each of the one or more tap handles is received within the one or more corresponding handle apertures of the handle block; and securing the tap block relative to the one or more tap nozzles and the handle block relative to the one or more tap handles by use of the one or more securing devices.

It is another objective of the invention to provide a tap lock for use on a soda gun in a bar or tavern. This form of the tap lock can be utilized to deter any dispensing of fluids through the nozzle of the soda gun.

It is still another objective of the invention to provide a tap lock that can be used on a tap to prevent a tap nozzle from being placed in a normal position of ordinary use. This invention not only deters persons from dispensing any liquid but frustrates the steps of ordinary use of the tap nozzle. As such, the present invention can be used on a gasoline nozzle. Such use would not allow a person to insert a gasoline nozzle into a gasoline tank of a vehicle. In this form, the present invention could be used at facilities such as bus lots or farms.

It is yet another objective of the invention to provide a tap lock that can be for used on a single outdoor water faucet or tap of a house. The tap lock in this form can be utilized to deter the dispensing of water by persons other than an authorized person to minimize water consumption in areas where water is scarce, relatively expensive, or rationed. This form of the invention could also be employed at campsites or recreational vehicle parks where patrons are expected to pay for various services used.

These and other objectives and advantages achieved by the invention will be further understood upon consideration of the following detailed description of embodiments of the invention taken in conjunction with the drawings, in which:

DETAILED DESCRIPTION OF EMBODIMENTS OF THE INVENTION

The embodiments of the invention described hereinafter have been particularly adapted for use with a tap system having one or more taps for dispensing fluid(s).

Figure 1:
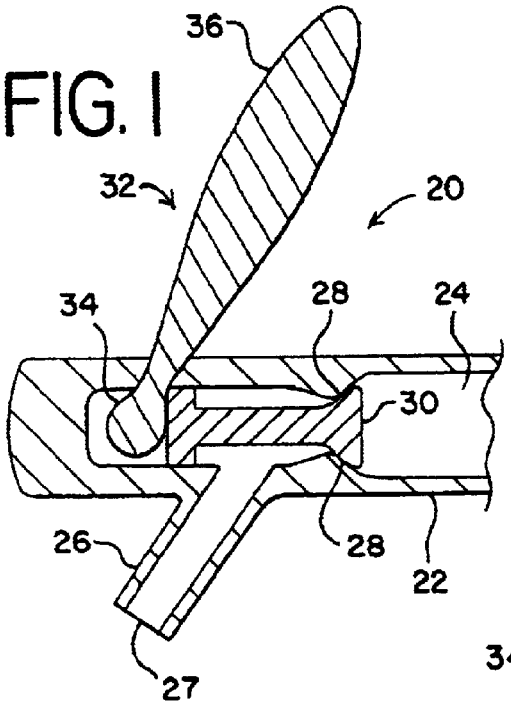
FIG. 1 is a right cross sectional view of a tap in a closed position.

FIG. 1 depicts a cross-sectional view of a conventional tap 20. The conventional tap 20 includes a hollow shank 22 with an exterior surface and an interior surface. The interior surface of the hollow shank 22 forms an internal flow path 24. The internal flow path 24 hydraulically connects the tap 20 to a reservoir or fluid supply (not shown). The flow path 24 is also hydraulically connected to a nozzle 26. The nozzle has a nozzle outlet 27, an interior surface and an exterior surface. A valve seat 28 is formed circumferentially within the flow path 24. A valve 30 is situated within the flow path 24 such that the valve 30 can be seated within the valve seat 28 to seal the flow path 24 thereby preventing any flow of fluid.

A tap handle 32 having an interior end 34 and an exterior end 36 is pivotally positioned and configured as to have the interior end 34 of the tap handle inside the hollow shank 22 and in mechanical communication with the valve 30.

Figure 2:
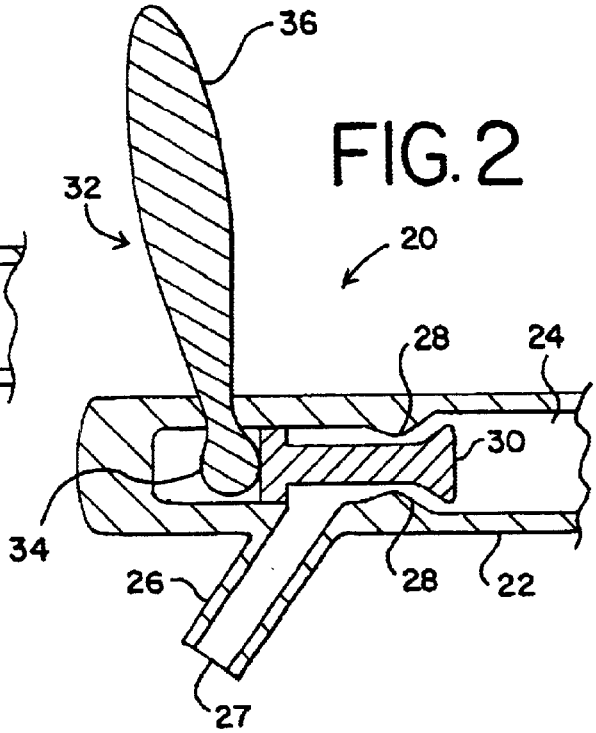
FIG. 2 is a right cross sectional view of a tap in an open position.

The valve 30 can be in an "open" position or a "closed" position (See FIG. 2). Any movement of the tap handle 32 results in an un-seating of the valve 30 from the valve seat 28. The tap handle 32 extends through the hollow shank 22 and into the flow path 24. The interior portion of tap handle 34 located within the flow path 24 is configured such that movement of the tap handle 32 can control any movement of the valve 30 relative to the valve seat 28. Packing (not shown) is located about the tap handle 32 where the tap handle 32 extends through the hollow shank to prevent any fluid from leaking from the flow path 24. A packing nut (not shown) is attached to the exterior of the hollow shank and about the tap handle to retain the packing and the portion of tap handle located within the flow path. Examples of taps include soda fountain dispensers, taps towers for dispensing beer in bars, water faucets at one's home, and gasoline nozzles. Taps are convenient because a user can quickly and easily provide flow of fluid from the tap with a minimal amount of effort. On the other hand, the convenience of the tap has a drawback in that unauthorized users can also draw fluid from an unattended tap.

Figure 3:
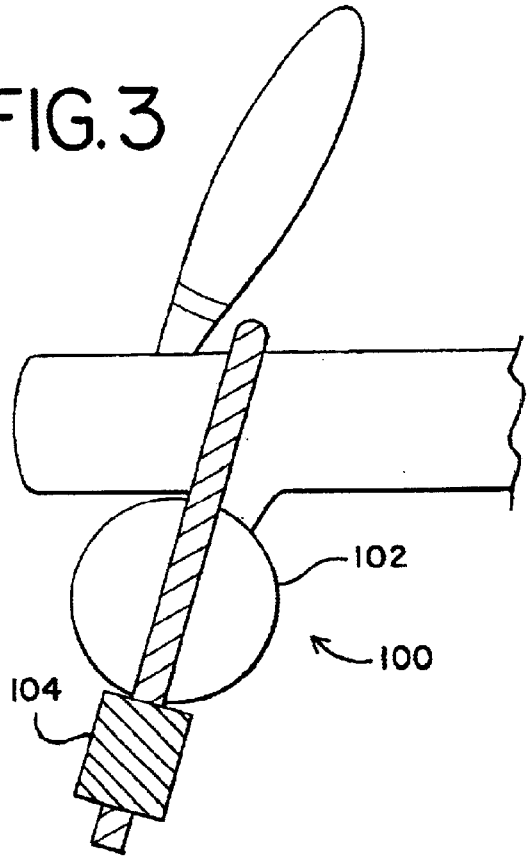
FIG. 3 is a right view of an embodiment of a tap lock of the present invention employed on a single tap.

FIG. 3 depicts a right view of a tap lock 100 for deterring any dispensing of fluid from a tap system. The embodiment depicted in FIG. 1 is designed for use with a tap system having only one tap. The tap lock 100 is comprised of a tap block 102 and a securing device 104. The tap block 100 has an exterior surface and an interior surface. The interior surface of the tap block forms an nozzle receiving cavity and a nozzle receiving aperture opening.

Figure 4:
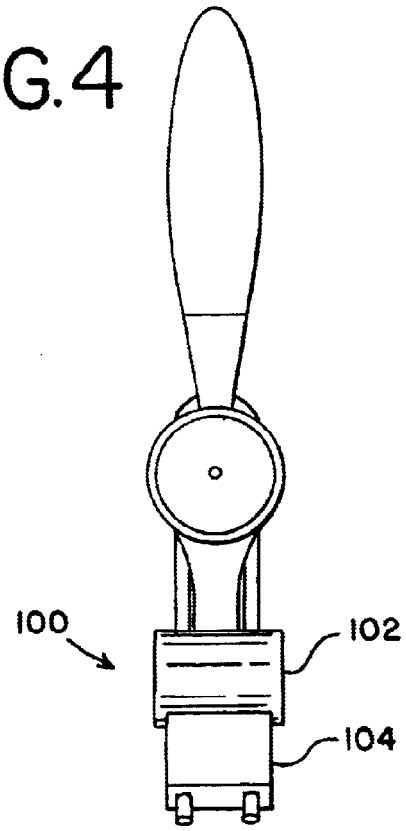
FIG. 4 is a frontal view of the embodiment of a tap lock of FIG. 3.

FIG. 4 depicts the front view of the tap and tap lock of FIG. 3.

Figure 5:
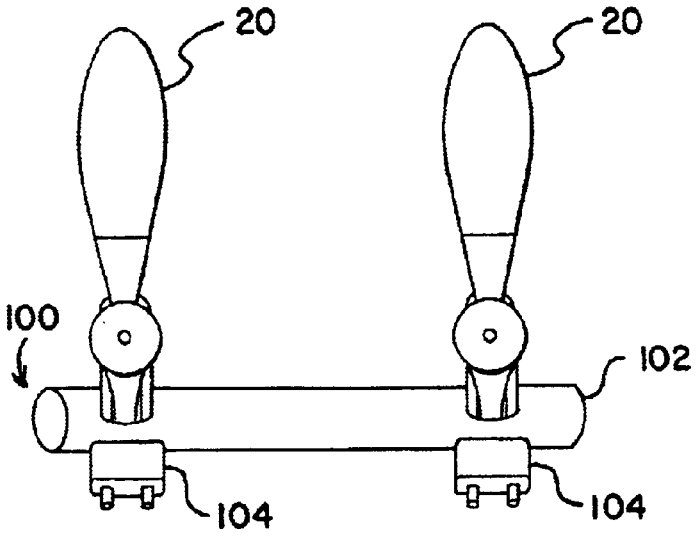
FIG. 5 is a frontal view of another embodiment of a tap lock employed on two taps of a tap tower.

FIG. 5 depicts a front view of a tap tower with two taps 20, a tap lock 100 of the present invention and two securing devices 104.

Figure 6:
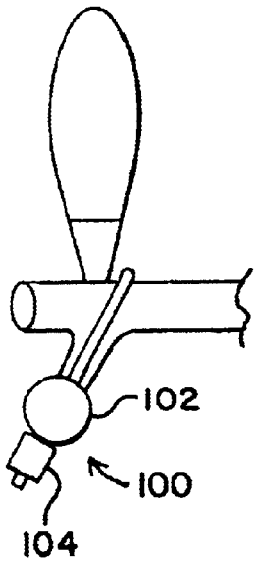
FIG. 6 is a right view of the tap lock and tap tower of FIG. 5.

FIG. 6 depicts the right view of the taps 10 and the tap lock 100 of FIG. 5.

Figure 7:
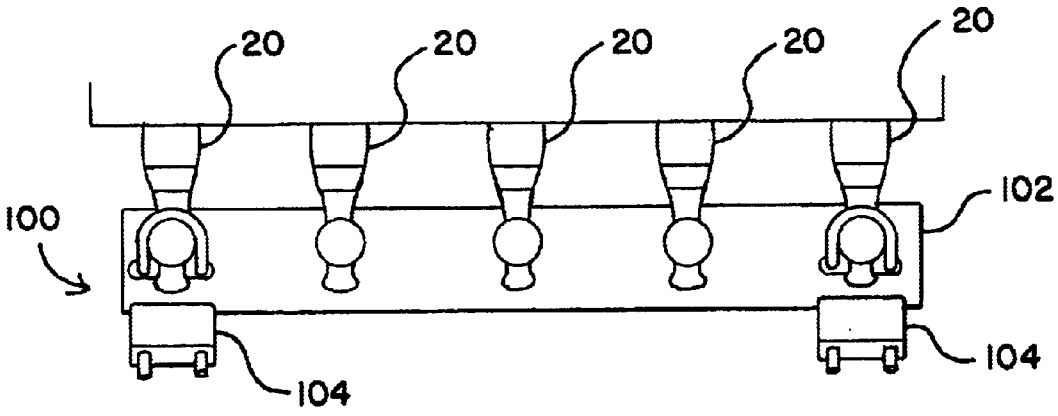
FIG. 7 is a top view of another embodiment of a tap lock employed on a five-tap tap tower.

FIG. 7 depicts a top view of a tap tower having five taps 20, a tap block 102, and two securing devices 104.

Figure 8:
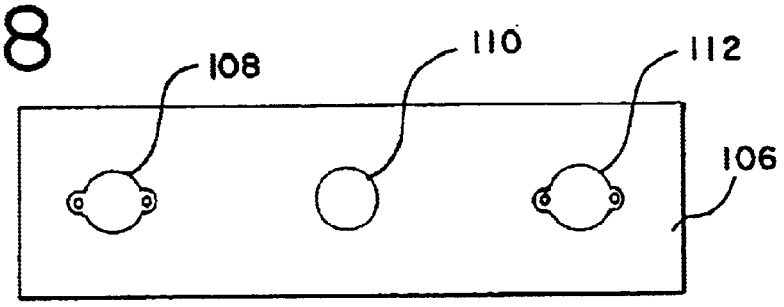
FIG. 8 is a top view of an embodiment of a handle block of a tap lock for deterring or hindering removal of tap handles for a three-tap tap tower.

FIG. 8 depicts a top view of a handle block 106 for use on a three-tap tower. The handle block 106 may be made from any ridged material that is not readily deformable and can withstand mild impacts. Brass or copper are examples of such materials. Threes apertures 108, 110, and 112 are fashioned in c&t the handle block 106, corresponding in number and location to each tap of the three-tap tower. Apertures 108 and 112 are elongated in shape to aid in attaching two securing devices (not shown).

Figure 9:
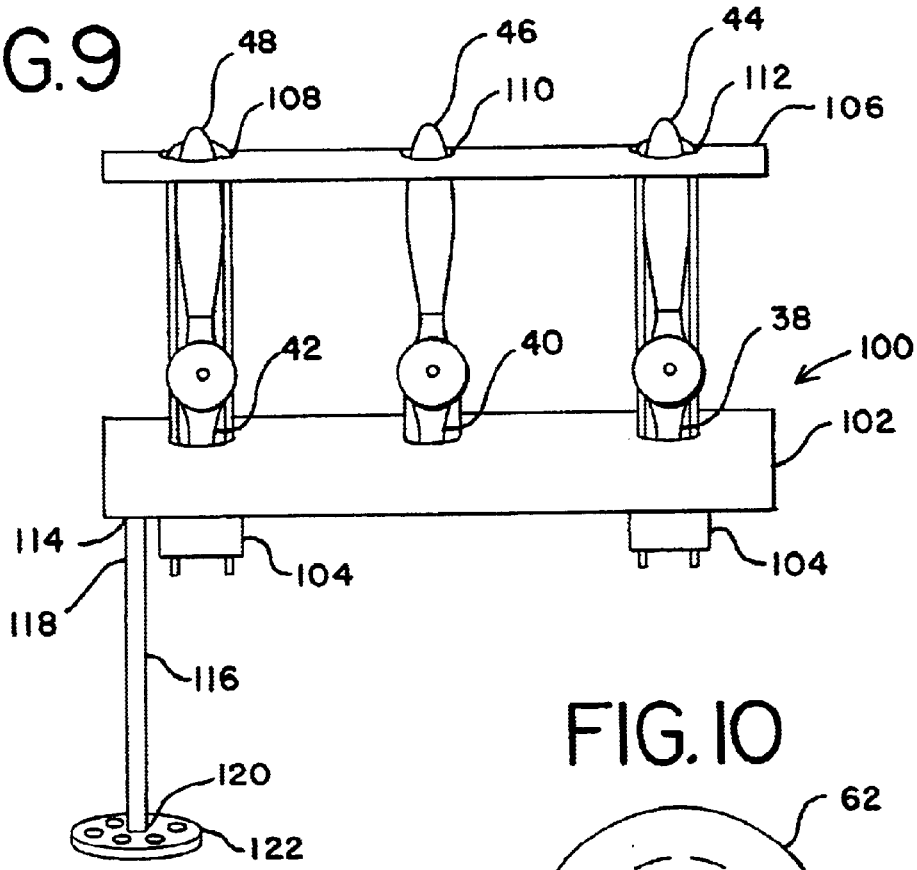
FIG. 9 is a frontal view of an embodiment of a tap block, a handle block, and two securing devices employed on a three-tap tap tower.

FIG. 9 depicts a front view of yet an embodiment of a tap lock The tap lock 100 is comprised of a tap block 102 and a handle block 106. The tap block 102 has apertures that are designed to correlate in the, number and location of tap nozzles 38, 40, and 42. When in use, as depicted in FIG. 9, the tap block 102 is positioned on the tap tower such that the tap nozzles 38, 40, and 42 are positioned within the apertures, respectively. In this embodiment, the handle block 106 is also incorporated to prevent theft of beer tap handles 44, 46, and 48. The handle block 106 has three apertures positioned within the handle block 106. When the handle block is situated on top of the tap handles 44, 46, and 48, the tap handles 44, 46, and 48 fit snugly within the apertures 108, 110, and 112. The-tap block 102 and the handle block 106 are held in place by one or more securing devices 104.

FIG. 9 also depicts the tap block 102 having a hydraulic outlet 114. The hydraulic outlet is in fluid communication with the nozzle receiving area or the apertures 38, 40, 42 which the tap nozzles are positioned within. FIG. 9 also depicts a drain conduit 116 having a first end 118 and a second end 120. The first end 118 of the drain conduit 116 is connected to and is in fluid communication with the hydraulic outlet 114 of the block wall or tap block 102. The second end 120 of the drain conduit 116 is configured to be inaccessible to a user and is in fluid communication with a d rain 122.

Figure 10:
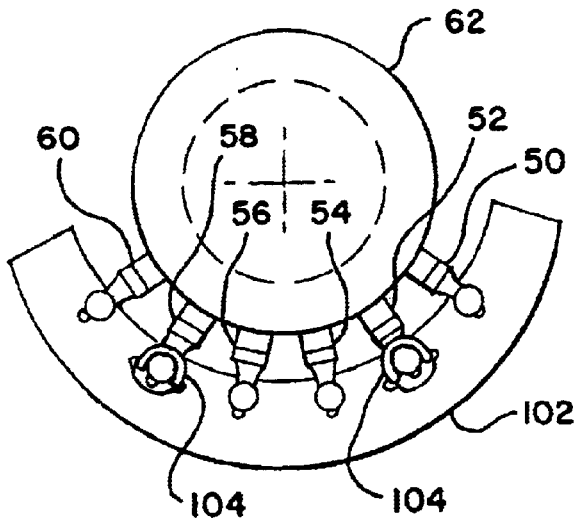
FIG. 10 is a top view of an embodiment of a tap block employed on a six-tap circular tap tower.

FIG. 10 depicts a top view of yet another embodiment of the invention used on a circular tap tower 62 with five taps 50, 52, 54, 56, 58, and 60.

In yet another embodiment of the invention could be custom designed by beer distributor and provided to bars and saloons. Such a tap lock with a handle block could be formed and configured so that the lock could only be used with the beer distributor's tap handle and product in a premium location on a tap tower.

Thus, while the invention has been disclosed and described with respect to certain embodiments, those of skill in the art have recognized modifications, changes, other applications and the like which will nonetheless fall within the spirit and ambit of the invention, and the following claims are intended to capture such variations.

I claim:

1. An apparatus for deterring operation of a tap, the tap having a tap handle, a hollow shank, a nozzle including a nozzle interior surface defining an internal flow path through which a fluid flows to a nozzle outlet, and a nozzle exterior surface, said apparatus comprising:

a tap block, said tap block including a block wall having a block exterior surface and a block interior surface, said block interior surface defining a nozzle receiving cavity sized and shaped relative to the nozzle exterior surface such that at least a portion of the nozzle adjacent to the nozzle outlet is received therein, said block wall including a nozzle receiving aperture opening from said block exterior surface through said block wall to said nozzle receiving cavity, said nozzle receiving aperture opening sized and shaped relative to the nozzle exterior surface such that at least the nozzle portion insertable into said nozzle receiving cavity is received therethrough; and a securing device, said securing device is capable of maintaining said position of said tap block relative to the tap nozzle.

2. An apparatus for deterring operation of a tap, the tap having a tap handle, a hollow shank, a nozzle including a nozzle interior surface defining an internal flow path through which a fluid flows to a nozzle outlet, and a nozzle exterior surface, said apparatus comprising:

a tap block, said tap block including a block wall having a block exterior surface and a block interior surface, said block interior surface defining a nozzle receiving cavity sized and shaped relative to the nozzle exterior surface such that at least a portion of the nozzle adjacent to the nozzle outlet is received therein, said block wall including a nozzle receiving aperture opening from said block exterior surface through said block wall to said nozzle receiving cavity, said nozzle receiving aperture opening sized and shaped relative to the nozzle exterior surface such that at least the nozzle portion insertable into said nozzle receiving cavity is received therethrough, said block wall including a hydraulic outlet, said hydraulic outlet in fluid communication with said nozzle receiving cavity;

a drain conduit including a first end and a second end, said first end of said drain conduit is connected to said hydraulic outlet and is in fluid communication with said hydraulic outlet of said block wall, said second end of said drain conduit is configured as to be inaccessible to a user and is in fluid communication with a drain;

the drain, said drain conduit, said hydraulic outlet, and said nozzle receiving cavity are configured as to all be in fluid communication with each other; and a securing device, said securing device is capable of maintaining said position of said tap block relative to the tap nozzle.

3. An apparatus for deterring operation of a tap, the tap having a tap handle, a hollow shank, a nozzle including a nozzle interior surface defining an internal flow path through which a fluid flows to a nozzle outlet, and a nozzle exterior surface, said apparatus comprising:

a tap block, said tap block including a block wall having a block exterior surface, said block exterior surface defining a protrusion sized and shaped relative to the nozzle outlet and nozzle interior surface such that at least a portion of said protrusion insertable into the nozzle outlet is received therethrough; and a securing device, said securing device is capable of maintaining said position of said tap block relative to the tap nozzle.

4. An apparatus for deterring operation of a tap, the tap having a tap handle having an exterior surface, a hollow shank, a nozzle including a nozzle interior surface defining an internal flow path through which a fluid flows to a nozzle outlet, and a nozzle exterior surface, said apparatus comprising:

a tap block, said tap block including a block wall having a block exterior surface and a block interior surface, said block interior surface defining a nozzle receiving cavity sized and shaped relative to the nozzle exterior surface such that at least a portion of the nozzle adjacent to the nozzle outlet is received therein, said block wall including a nozzle receiving aperture opening from said block exterior surface through said block wall to said nozzle receiving cavity, said nozzle receiving aperture opening sized and shaped relative to the nozzle exterior surface such that at least the nozzle portion insertable into said nozzle receiving cavity is received therethrough;

a handle block, said handle block including a handle block wall having a handle block exterior surface and a handle block interior surface, said handle block interior surface defining a handle receiving aperture opening sized and shaped relative to the handle exterior surface such that at least a portion of the handle is received therein, said handle block wall including a handle receiving aperture opening from said handle block exterior surface through said handle block wall to said handle receiving cavity, said handle receiving aperture opening sized and shaped relative to the handle exterior surface such that at least the handle portion insertable into said handle receiving cavity is received therethrough; and a securing device, said securing device is capable of maintaining said position of said tap block relative to the tap nozzle and said position of said handle block relative to the tap handle.

5. An apparatus for deterring operation of one or more taps of a tap tower, each of the one or more taps having a tap handle, a hollow shank, a nozzle including a nozzle interior surface defining an internal flow path through which a fluid flows to a nozzle outlet, and a nozzle exterior surface, said apparatus comprising:

a tap block, said tap block including a block wall having a block exterior surface and a block interior surface, said block interior surface defining one or more nozzle receiving cavities that correspond to the one or more taps, said one or more nozzle receiving cavities sized and shaped relative to the one or more corresponding nozzle exterior surfaces such that at least a portion of the corresponding nozzle adjacent to the corresponding nozzle outlet is received therein, said block wall including one or more nozzle receiving aperture openings from said block exterior surface through said block wall to said corresponding nozzle receiving cavities, said one or more nozzle receiving aperture openings sized and shaped relative to the corresponding nozzle exterior surface such that the portion of the corresponding nozzle portion insertable into the corresponding nozzle receiving cavity is received therethrough; and one or more securing devices, said one or more securing devices capable of maintaining said position of said tap block relative to the one or more tap nozzles.

6. An apparatus for deterring operation of one or more taps of a tap tower, each of the one or more taps having a tap handle, a hollow shank, a nozzle including a nozzle interior surface defining an internal flow path through which a fluid flows to a nozzle outlet, and a nozzle exterior surface, said apparatus comprising:

a tap block, said tap block including a block wall having a block exterior surface and a block interior surface, said block interior surface defining one or more nozzle receiving cavities sized and shaped relative to the one or more corresponding nozzle exterior surfaces such that at least a portion of the corresponding nozzle adjacent to the corresponding nozzle outlet is received therein, said block wall including one or more nozzle receiving aperture openings from said block exterior surface through said block wall to said corresponding nozzle receiving cavities, said one or more nozzle receiving aperture openings sized and shaped relative to the corresponding nozzle exterior surface such that the corresponding nozzle portion insertable into said nozzle receiving cavity is received therethrough, said block wall including one or more hydraulic outlets, said hydraulic outlets in fluid communication with said one or more corresponding nozzle receiving cavities;

a drain conduit including a first end and a second end, said first end of said drain conduit is connected to said one or more hydraulic outlets and is in fluid communication with said one or more hydraulic outlets of said block wall, said second end of said drain conduit is configured as to be inaccessible to a user and is in fluid communication with a drain;

the drain, said drain conduit, said one or more hydraulic outlets, and said one or more nozzle receiving cavities are configured as to all be in fluid communication with each other; and one or more securing devices, said one or more securing devices capable of maintaining said position of said tap block relative to the one or more tap nozzles.

7. An apparatus for deterring operation of one or more taps of a tap tower, each of the one or more taps having a tap handle, a hollow shank, a nozzle including a nozzle interior surface defining an internal flow path through which a fluid flows to a nozzle outlet, and a nozzle exterior surface, said apparatus comprising:

a tap block, said tap block including a block wall having a block exterior surface, said block exterior surface defining one or more protrusions; each of said one or more protrusions correspond to one of the one or more taps and each of said one or more protrusions are sized and shaped relative to the corresponding nozzle outlets and corresponding one or more nozzle interior surfaces such that at least a portion of said one or more protrusions insertable into the corresponding nozzle outlet is received therethrough; and one or more securing devices, said one or more securing devices capable of maintaining said position of said tap block relative to the one or more tap nozzles.

8. An apparatus for deterring operation of one or more taps of a tap tower, each of the one or more taps having a tap handle having an exterior surface, a hollow shank, a nozzle including a nozzle interior surface defining an internal flow path through which a fluid flows to a nozzle outlet, and a nozzle exterior surface, said apparatus comprising:

a tap block, said tap block including a block wall having a block exterior surface and a block interior surface, said block interior surface defining one or more nozzle receiving cavities; each of said one or more nozzle receiving cavities correspond to one of the one or more taps and each of said one or more nozzle receiving cavities are sized and shaped relative to the corresponding nozzle exterior surface such that at least a portion of the corresponding nozzle adjacent to the corresponding nozzle outlet is received therein, said block wall including a one or more nozzle receiving aperture openings from said block exterior surface through said block wall to said corresponding one or more nozzle receiving cavities, said nozzle receiving aperture openings sized and shaped relative to the corresponding nozzle exterior surface such that at least the corresponding nozzle portion insertable into said corresponding nozzle receiving cavity is received therethrough;

a handle block, said handle block including a handle block wall having a handle block exterior surface and a handle block interior surface, said handle block interior surface defining one or more handle receiving cavities; each of said one or more handle receiving cavities correspond to one of the one or more handles of the one or more taps and each of said one or more handle receiving cavities are sized and shaped relative to the corresponding handle exterior surface such that at least a portion of the corresponding handle is received therein, said handle block wall including a one or more handle receiving aperture openings from said handle block exterior surface through said handle block wall to said corresponding handle receiving cavities, said handle receiving aperture openings sized and shaped relative to the corresponding handle exterior surface such that at least the corresponding handle portion insertable into said corresponding handle receiving cavity is received therethrough; and one or more securing devices, said one or more securing devices capable of maintaining said position of said tap block relative to the one or more tap nozzles and said position of said handle block relative to the one or more tap handles.

9. A method of deterring opening or operation of one or more taps of a tap tower, each of the one or more taps having a tap handle, a hollow shank, a nozzle including a nozzle interior surface defining an internal flow path through which a fluid flows to a nozzle outlet, and a nozzle exterior surface, by use of a tap lock having a tap block, said tap block including a block wall having a block exterior surface and a block interior surface, said block interior surface defining one or more nozzle receiving cavities that correspond to the one or more taps, said one or more nozzle receiving cavities sized and shaped relative to the one or more corresponding nozzle exterior surfaces such that at least a portion of the corresponding nozzle adjacent to the corresponding nozzle outlet is received therein, said block wall including one or more nozzle receiving aperture openings from said block exterior surface through said block wall to said corresponding nozzle receiving cavities, said one or more nozzle receiving aperture openings sized and shaped relative to the corresponding nozzle exterior surface such that the corresponding nozzle portion insertable into the corresponding nozzle receiving cavity is received therethrough; and one or more securing devices, said one or more securing devices capable of maintaining said position of said tap block relative to the one or more tap nozzles, the method comprising the steps of:

positioning said tap block such that a portion of each of the one or more tap nozzles is received within said corresponding one or more nozzle receiving cavities; and securing said tap block relative to the one or more tap nozzles by use of said one or more securing devices.

10. A method of deterring opening or operation of one or more taps of a tap tower, each of the one or more taps having a tap handle, a hollow shank, a nozzle including a nozzle interior surface defining an internal flow path through which a fluid flows to a nozzle outlet, and a nozzle exterior surface, by use of a tap lock having:

a tap block, said tap block including a block wall having a block exterior surface and a block interior surface, said block interior surface defining one or more nozzle receiving cavities sized and shaped relative to the one or more corresponding nozzle exterior surfaces such that at least a portion of the corresponding nozzle adjacent to the corresponding nozzle outlet is received therein, said block wall including one or more nozzle receiving aperture openings from said block exterior surface through said block wall to said corresponding nozzle receiving cavities, said one or more nozzle receiving aperture openings sized and shaped relative to the corresponding nozzle exterior surface such that the corresponding nozzle portion insertable into said nozzle receiving cavity is received therethrough, said block wall including one or more hydraulic outlets, said hydraulic outlets in fluid communication with said one or more corresponding nozzle receiving cavity;

a drain conduit including a first end and a second end, said first end of said drain conduit is connected to said one or more hydraulic outlets and is in fluid communication with said one or more hydraulic outlets of said block wall, said second end of said drain conduit is configured as to be inaccessible to a user and is in fluid communication with a drain;

the drain, said drain conduit, said one or more hydraulic outlets, and said one or more nozzle receiving cavities are configured as to all be in fluid communication with each other; and one or more securing devices, said one or more securing devices capable of maintaining said position of said tap block relative to the one or more tap nozzles, the method comprising the steps of:

positioning said tap block such that a portion of each of the one or more tap nozzles is received within said corresponding one or more nozzle receiving cavities; and securing said tap block relative to the one or more tap nozzles by use of said one or more securing devices.

11. A method of deterring opening or operation of one or more taps of a tap tower, each of the one or more taps having a tap handle, a hollow shank, a nozzle including a nozzle interior surface defining an internal flow path through which a fluid flows to a nozzle outlet, and a nozzle exterior surface, by use of a tap lock having:

a tap block, said tap block including a block wall having a block exterior surface and a block interior surface, said block exterior surface defining one or more protrusions; each of said one or more protrusions correspond to one of the one or more taps and each of said one or more protrusions are sized and shaped relative to the corresponding one or more nozzle outlets and corresponding nozzle interior surfaces such that at least a portion of said one or more protrusions insertable into the corresponding nozzle outlet is received therethrough; and one or more securing devices, said one or more securing devices capable of maintaining said position of said tap block relative to the one or more tap nozzles, the method comprising the steps of:

positioning said tap block such that each of the one or more protrusions of the tap block is received each of the one or more tap nozzles of the tap tower; and securing said tap block relative to the one or more tap nozzles by use of said one or more securing devices.

12. A method of deterring opening or operation of one or more taps of a tap tower, each of the one or more taps having a tap handle having an exterior surface, a hollow shank, a nozzle including a nozzle interior surface defining an internal flow path through which a fluid flows to a nozzle outlet, and a nozzle exterior surface, by use of a tap lock having:

a tap block, said tap block including a block wall having a block exterior surface and a block interior surface, said block interior surface defining one or more nozzle receiving cavities; each of said one or more nozzle receiving cavities correspond to one of the one or more taps and each of said one or more nozzle receiving cavities are sized and shaped relative to the corresponding nozzle exterior surface such that at least a portion of the corresponding nozzle adjacent to the corresponding nozzle outlet is received therein, said block wall including a one or more nozzle receiving aperture openings from said block exterior surface through said block wall to said corresponding one or more nozzle receiving cavities, said nozzle receiving aperture openings sized and shaped relative to the corresponding nozzle exterior surface such that at least the corresponding nozzle portion insertable into said corresponding nozzle receiving cavity is received therethrough;

a handle block, said handle block including a handle block wall having a handle block exterior surface and a handle block interior surface, said handle block interior surface defining one or more handle receiving cavities; each of said one or more handle receiving cavities correspond to one of the one or more handles of the one or more taps and each of said one or more handle receiving cavities are sized and shaped relative to the corresponding handle exterior surface such that at least a portion of the corresponding handle is received therein, said handle block wall including a one or more handle receiving aperture openings from said handle block exterior surface through said handle block wall to said corresponding handle receiving cavities, said handle receiving aperture openings sized and shaped relative to the corresponding handle exterior surface such that at least the corresponding handle portion insertable into said corresponding handle receiving cavity is received therethrough; and one or more securing devices, said one or more securing devices capable of maintaining said position of said tap block relative to the one or more tap nozzles and maintaining said position of said handle block relative to the one or more tap handles, the method comprising the steps of:

positioning said tap block such that a portion of each of the one or more tap nozzles is received within said corresponding one or more nozzle receiving cavities;

positioning said handle block such that a portion of each of the one or more tap handles is received within said one or more corresponding handle apertures of said handle block; and securing said tap block relative to the one or more tap nozzles and said handle block relative to the one or more tap handles y use of one or more securing devices.

* * * * *